US011396731B2

(12) United States Patent
Ji et al.

(10) Patent No.: US 11,396,731 B2
(45) Date of Patent: Jul. 26, 2022

(54) FLOATING GARBAGE CLEANING DEVICE FOR FLOATING GARBAGE ON WATER SURFACE

(71) Applicant: JIANGSU UNIVERSITY OF SCIENCE AND TECHNOLOGY, Zhenjiang (CN)

(72) Inventors: Chunyan Ji, Zhenjiang (CN); Renchuan Ye, Zhenjiang (CN); Jie Cui, Zhenjiang (CN); Jianting Guo, Zhenjiang (CN)

(73) Assignee: JIANGSU UNIVERSITY OF SCIENCE AND TECHNOLOGY, Zhenjiang (CN)

( * ) Notice: Subject to any disclaimer, the term of this patent is extended or adjusted under 35 U.S.C. 154(b) by 0 days.

(21) Appl. No.: 17/260,238

(22) PCT Filed: Feb. 25, 2020

(86) PCT No.: PCT/CN2020/076508
§ 371 (c)(1),
(2) Date: Jan. 14, 2021

(87) PCT Pub. No.: WO2020/207133
PCT Pub. Date: Oct. 15, 2020

(65) Prior Publication Data

US 2022/0106756 A1 Apr. 7, 2022

(30) Foreign Application Priority Data

Apr. 12, 2019 (CN) ..... 201910294431.6

(51) Int. Cl.
*E02B 15/06* (2006.01)
*E02B 15/10* (2006.01)
*E02B 15/08* (2006.01)

(52) U.S. Cl.
CPC ..... *E02B 15/10* (2013.01); *E02B 15/06* (2013.01); *E02B 15/0807* (2013.01); *E02B 15/0814* (2013.01)

(58) Field of Classification Search
CPC ..... E02B 15/06; E02B 15/08; E02B 15/0807; E02B 15/0814; E02B 15/10
(Continued)

(56) References Cited

U.S. PATENT DOCUMENTS 3,590,584 A * 7/1971 Fitzgerald ..... E02B 15/06 210/242.3
3,768,656 A * 10/1973 Nugent ..... E02B 15/06 405/63

(Continued)

FOREIGN PATENT DOCUMENTS

FR 2832168 * 5/2003

*Primary Examiner* — Christopher Upton
(74) *Attorney, Agent, or Firm* — CBM Patent Consulting, LLC

(57) ABSTRACT

A floating garbage cleaning device for floating garbage on water comprises a plurality of single-section flexible floating bodies which are sequentially connected to form an ultra-long flexible floating body main body; every two adjacent single-section flexible floating bodies are connected through a butt joint device; two ends of longitudinal flexible rods; flexible transverse nets and flexible longitudinal nets are arranged between the longitudinal flexible rods in a spaced and covering manner; stabilizing buoys are fixed with the ultra-long flexible floating body main body; intercepting net aprons are arranged at the bottom of the ultra-long flexible floating body main body; counterweights are arranged at the bottoms of the interception net aprons; garbage collection nets are arranged between two adjacent single-section flexible floating bodies; and the ultra-long flexible floating body main body is provided with a mooring system.

5 Claims, 4 Drawing Sheets

(58) Field of Classification Search
USPC ... 210/170.05, 170.09, 170.11, 242.1, 242.3, 210/747.6, 776; 405/60, 63
See application file for complete search history.

(56) References Cited

U.S. PATENT DOCUMENTS 4,062,191 A * 12/1977 Preus ..... E02B 15/0814 405/72
4,211,659 A * 7/1980 Nyfeldt ..... E02B 15/0814 210/242.3
4,554,072 A * 11/1985 Ayers ..... E02B 15/0842 210/242.3
4,738,563 A * 4/1988 Clark ..... E02B 5/08 405/63
4,802,791 A * 2/1989 Fisher ..... E02B 15/08 405/63
5,087,152 A * 2/1992 Whidden ..... E02B 15/0814 210/776
2008/0283457 A1* 11/2008 Weiss ..... E02B 15/08 210/170.09

* cited by examiner

FLOATING GARBAGE CLEANING DEVICE FOR FLOATING GARBAGE ON WATER SURFACE

FIELD OF TECHNOLOGY

The invention belongs to a marine structure technology, and particularly relates to a floating garbage cleaning device for floating garbage on water.

BACKGROUND

With the continuous upgrading of the design and manufacturing technology of aquatic structures, more and more human activities are carried out in open waters, the coastal population is getting denser, trade between rives and seas is getting more and more frequent, and the number of tourists on islands and distant seas continues to rise, which brings great pressure to the ecological environment of rivers, lakes and seas. Human activities for thousands of years are concentrated on the land. With the development of modern technology, human beings gradually recognize, develop and utilize oceans, and the ocean development is still under exploration, so a legal mechanism for environmental protection and garbage cleaning devices in open waters are also under exploration. Latest satellite cloud pictures show that the annual growth of floating garbage in the South China Sea alone exceeds 60,000 tons, and the pollution of floating garbage is very serious. The pollution of marine floating garbage and microplastics is a global emerging marine environmental problem that has attracted much attention. Most marine floating garbage will release toxic substances in the process of slow degradation. On the one hand, formed microplastics may be eaten by marine organisms, and non-degraded garbage may entangle marine organisms and hinder their mobility, thus posing a fatal threat to marine animals. On the other hand, degraded plastics become numerous microplastic fragments, which are accumulated in animals and plants through the food chain and lead to human ingestion of plastics. Studies at home and abroad have shown that microplastics have spread throughout the ocean. The pollution status of microplastics in organisms and the ecological effects and health risks caused by them are the top priority of current international microplastics research.

Therefore, in order to protect the ecological environment of open water, it is of great importance to design an efficient garbage cleaning device suitable for open water as soon as possible with respect to ocean environment protection.

SUMMARY

Object of the invention: an object of the invention is to overcome the defects in the prior art and provide a floating garbage cleaning device for floating on water, which can quickly clean floating garbage in large open waters.

According to the technical solution, the floating garbage cleaning device for floating garbage on water comprises a plurality of single-section flexible floating bodies, stabilizing buoys, interception net aprons, garbage collection nets and a mooring system, wherein the plurality of single-section flexible floating bodies are sequentially connected to form an flexible floating body main body which is arc-shaped as a whole; every two adjacent single-section flexible floating bodies are connected through a butt joint device (for example, a butt joint device is arranged at each of two ends of each flexible floating body, the single-section flexible floating bodies are sequentially connected from end to end); each single-section flexible floating body comprises a plurality of longitudinal flexible rods, flexible transverse nets and flexible longitudinal nets; two ends of the longitudinal flexible rods are respectively in butt joint with the butt joint devices at the two ends of the corresponding single-section flexible floating bodies; the flexible transverse nets and the flexible longitudinal nets are arranged between the longitudinal flexible rods in a spaced and covering manner; a plurality of buoyancy balls are arranged in each single-section flexible floating body; the stabilizing buoy is fixed (welded or riveted) with the flexible floating body; the intercepting net aprons are arranged at the bottom of the flexible floating body and counterweights are arranged at the bottoms of the intercepting net aprons (thus having the ability to prevent floating garbage from escaping from under the floating bodies, for example, a plurality of counterweight balls are hung at the bottoms of the intercepting net aprons, which can ensure that the net aprons are perpendicular to the flow velocity direction); the garbage collection nets are arranged between two adjacent single-section flexible floating bodies; and the flexible floating body main body is provided with a mooring system.

Further, in order to increase the buoyancy of the whole device, the single-section flexible floating body is in the shape of a cylinder, and a barrier net is installed between every two adjacent single-section flexible floating bodies (which can prevent the buoyancy balls from escaping or leaking out, thus maintaining the buoyancy stability of each section), one garbage collection net is hung between two adjacent barrier nets, and the garbage collection nets are arranged in a spaced manner.

In order to enhance the stability performance of the whole device, several stabilizing buoys are arranged, several solar power generation panels are arranged between the stabilizing buoys and the single-section flexible floating bodies, which provide energy for the whole device, for example, for controllers or warning lights installed on the floating cleaning device and onshore.

Further, the mooring system comprises mooring cables and an anchor; the number of the mooring cables is three in total; two ends of two of the three mooring cables are respectively connected with the single-section flexible floating bodies and a transition buoy; one end of the other one of the three mooring cables is connected with the transition buoy and the other end thereof is fixed to a water bottom through the anchor; and the transition buoy is arranged near the middle of an arc-shaped opening. The function of the transition buoy is to connect the cable on the water surface and the mooring cable to reduce the downward force of an flexible body. The specific position is determined based on a main dimension of a garbage cleaning system, and an installation position is near the middle of the arc-shaped opening.

The device is also provided with a positioning cable which is respectively connected to the two ends of the flexible floating body main body to keep a certain arc shape of the flexible floating body main body, and the shape and radian of the flexible floating body main body is adjusted by changing a length of the positioning cable.

In order to enhance the corrosion resistance, reduce the adhesion of aquatic organisms and enhance the toughness of the whole device, the longitudinal flexible rods are made of polymer PV materials, and the flexible transverse nets and flexible longitudinal nets are made of flexible nets with ultra-high molecular weight.

The invention has the advantages that floating garbage is collected in a collecting area of the device by the external force of wind, waves and streams. The design of this device fully considers the change factors of wind, wave and stream directions, and the whole device can change with the direction change of the floating garbage, thus filling the gap in the field of the floating garbage and the design field of floating garbage cleaning devices in China. Compared with the prior art, the invention has the following advantages:

(1) fixed-point arrangement can be realized by the mooring system, so that the device is suitable for areas where garbage passes through or is concentrated in open waters, and has strong applicability;

(2) the device has a garbage packing function, achieves garbage collection automation, and has high cleaning efficiency; and (3) the device has portability and is quick to disassemble and assemble, can be arranged in different waters by shifting the mooring system, and has good economy.

DESCRIPTION OF THE EMBODIMENTS

The technical solution of the present invention will be described in detail below, but the protection scope of the present invention is not limited to the embodiments.

Figure 1:
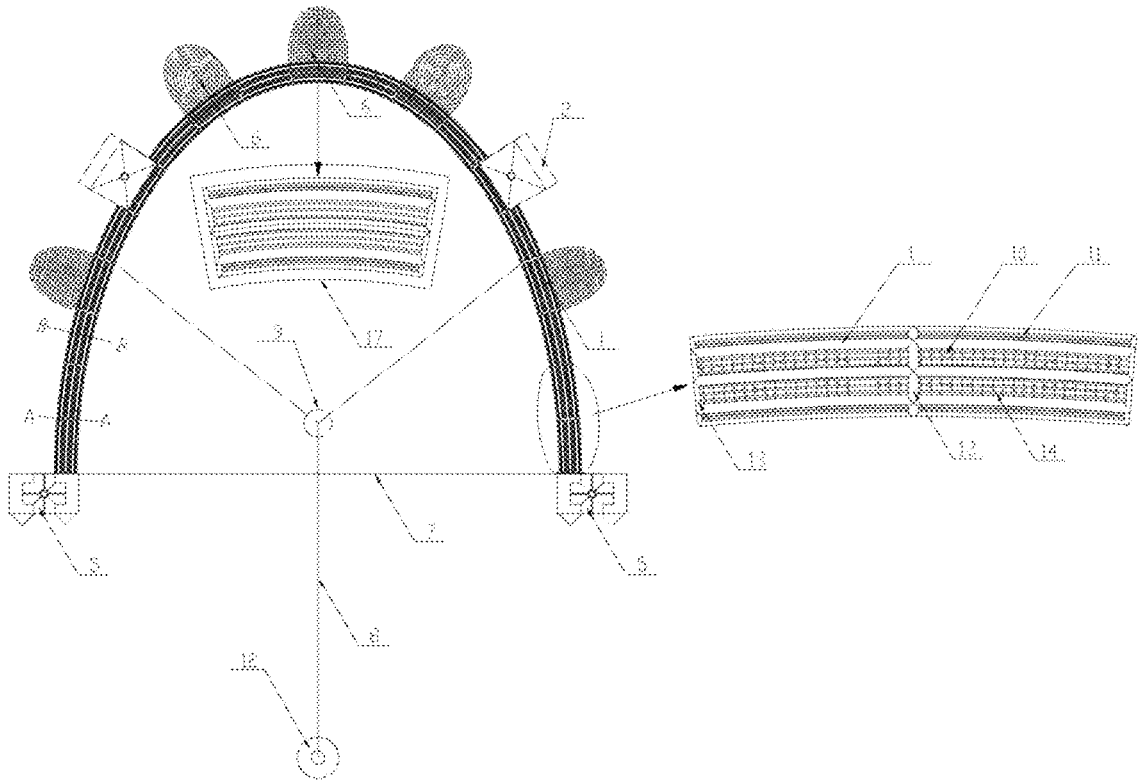
FIG. 1 is a top view of an overall structure of the present invention.
Figure 2:
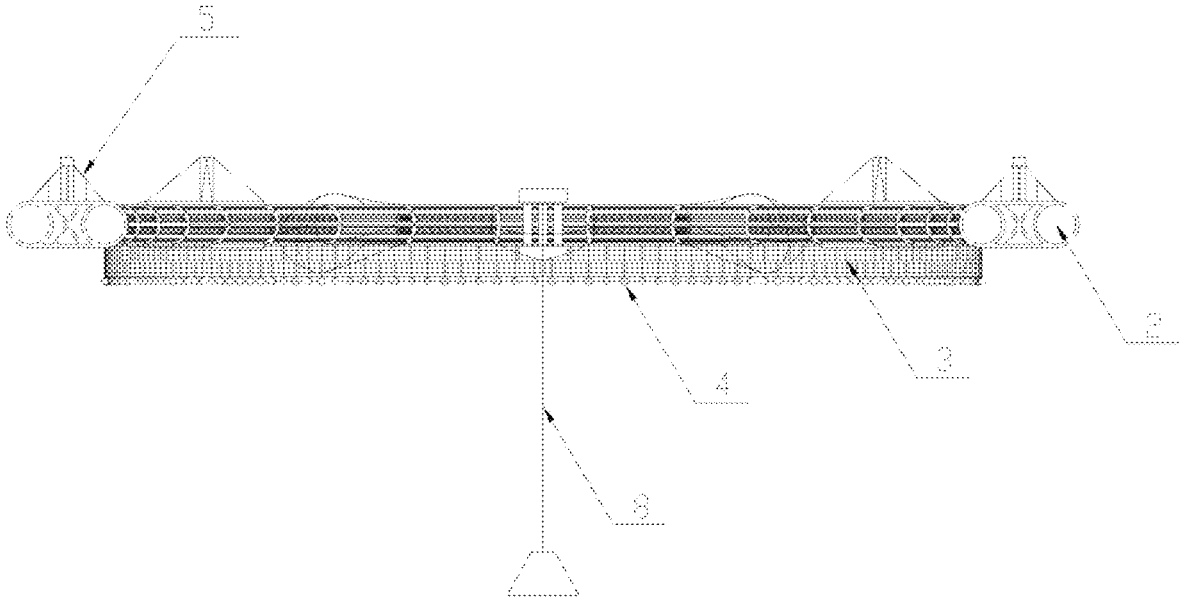
FIG. 2 is a front view of the overall structure of the present invention.
Figure 3:
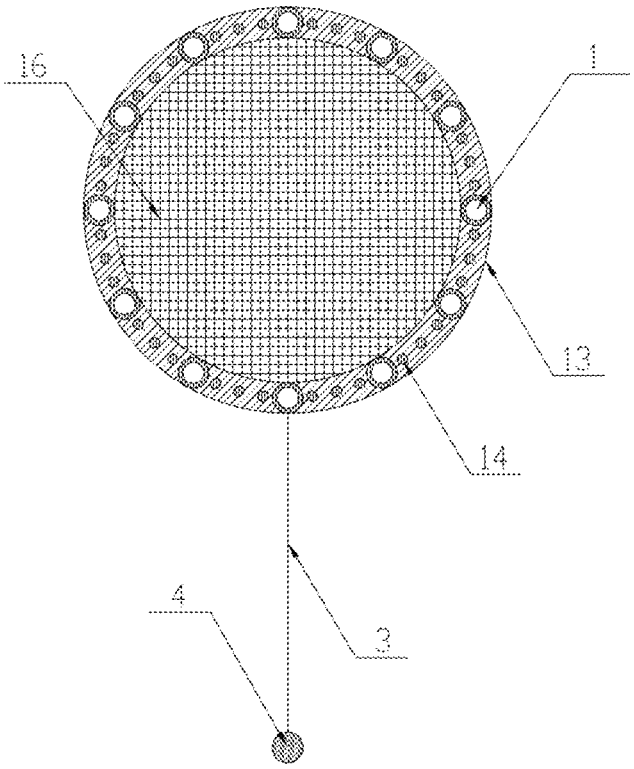
FIG. 3 is an enlarged view of a section A-A in FIG. 1.
Figure 4:
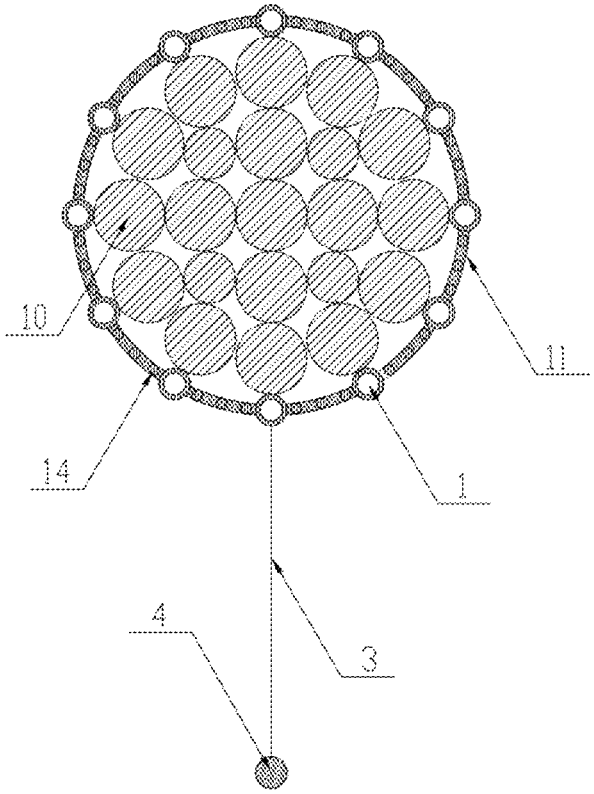
FIG. 4 is an enlarged view of a section B-B in FIG. 1.
Figure 5:
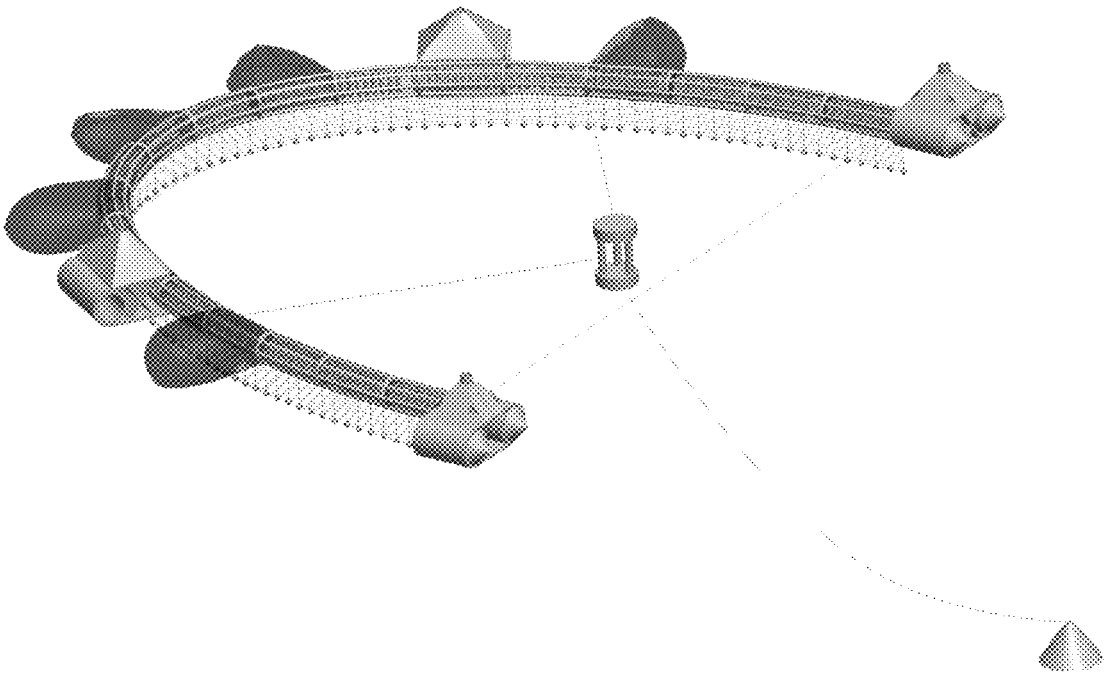
FIG. 5 is a schematic diagram of a three-dimensional structure of the present invention.
Figure 6:
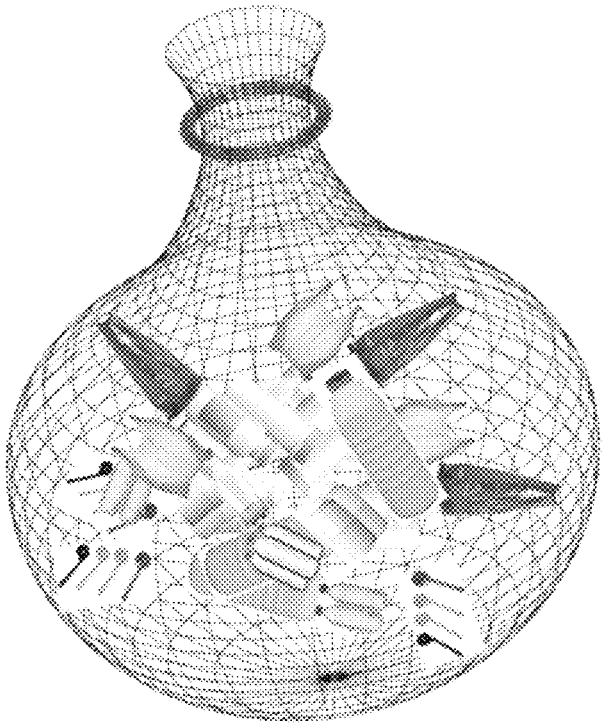
FIG. 6 is a schematic diagram of a floating garbage net bag to be transported after packing in an embodiment.

As shown in FIG. 1 to FIG. 4, an efficient floating garbage cleaning device for floating garbage on water of the present invention comprises a plurality of single-section flexible floating bodies, a stabilizing buoy, an intercepting net apron, a garbage collection net and a mooring system. The single-section flexible floating bodies 17 are connected sequentially to form an flexible floating body main body for intercepting floating garbage on the water in a large area; each single-section flexible floating body 17 comprises longitudinal flexible rods 1, transverse fixing structures 13, buoyancy balls 10, flexible transverse nets 11, flexible longitudinal nets 14 and barrier nets 16 between sections; an intercepting net apron 3 for preventing floating garbage from escaping is hung at the bottom of each single-section flexible floating body 17; and a counterweight ball 4 for ensuring that the intercepting net apron 3 is perpendicular to the flow velocity direction is hung at the bottom of the intercepting net apron 3. The floating garbage moves under the action of waves, tides and stream loads, enters the oval flexible floating bodies and is intercepted, and then gradually enters a garbage collection net 6, which is similar to a fishing net; once the floating garbage enters the net, it is difficult to escape; when the garbage collection net 6 is full of garbage, the garbage collection net automatically packs by remote control and waits for transportation by a garbage transport ship.

The garbage cleaning device rotates along a mooring point as a whole, and sends the floating garbage into the garbage collection net 6 through the movement of waves, tides and streams.

In this embodiment, for the convenience of transportation and the safety of the whole structure, the flexible floating body main body herein is formed by connecting and assembling single-section flexible floating bodies 17 one by one sequentially; and except for the single section where the garbage collection net 6 is installed without buoyancy balls 10 (the purpose of avoiding placing the buoyancy balls here is to allow the floating garbage to enter the garbage collection net 6 through the flexible floating body for packaging), a large number of buoyancy balls 10 are placed in other sections to ensure that the whole structure floats on the water.

Where, segments of the flexible floating body main body provided with the stabilizing buoys 2 and solar panels 5 have been installed before transportation, and are assembled after transportation to the sea, the whole structure can still operate normally after the single-section flexible floating bodies are separated from one another, and the separated single-section flexible floating bodies can be repaired and installed again. Therefore, the whole system has excellent safety, low manufacturing price and high stability.

After the flexible floating body main body is assembled, the intercepting net aprons 3 are arranged along the bottom of the flexible floating body main body, wherein the counterweight balls 4 has been installed on the intercepting net aprons 3 in the early stage, and the garbage collection nets 6 are installed after the intercepting net aprons 3 are completely installed; after the garbage collection nets 6 are installed, a positioning cable 7 needs to be installed at two ends of the flexible floating body main body, wherein the function of the positioning cable 7 is to keep the flexible floating body main body in a certain arc shape so as to collect the garbage floating head-on, and the installation of positioning cable 7 requires tightening by the power of the garbage transport ship. After one end of the positioning cable 7 is fixed, the other end thereof is tightened by the power of the garbage transport ship, and when the flexible floating body main body reaches a preset shape, the positioning cable 7 is locked, and the installation of the flexible floating body main body and its supporting equipment is completed; and finally, the whole mooring system is installed.

Firstly, two mooring cables 8 on the water are connected to the flexible floating body main body and a transition buoy 9 and finally one end of the mooring cable 8 connected to the sea floor is connected to the transition buoy 9, and the other end thereof is fixed to the water bottom through an anchor 12. The whole system can rotate around a fixed end point of the water bottom through the mooring cables, thus ensuring that the device can effectively collect the floating garbage under the action of wind, tides and stream loads in any direction.

Traditional methods and devices for recovering floating garbage on water (manual boat cleaning, professional garbage cleaning boat and garbage cleaning bucket at sea, etc.) are not only expensive and inefficient, but are mostly only suitable for some specific waters with less garbage, and are difficult to play a role when the floating garbage in the sea is serious, such as in typhoon, storm surge and bad sea conditions. The domestic research on the theory and application of floating garbage cleaning in large open sea areas is still rare.

It can be seen from the above embodiment that fixed-point arrangement can be realized by the mooring system, so that the device is suitable for garbage centralized areas in offshore waters; at the same time, the device has a function of garbage packing, achieves automation of garbage collection and has high collection efficiency; and the device has mobility, that is, it can be arranged in different waters by shifting the mooring system.

What is claimed is:

1. A floating garbage cleaning device for floating garbage on water, characterized by comprising a plurality of single-section flexible floating bodies, stabilizing buoys, intercepting net aprons, garbage collection nets and a mooring system, wherein the plurality of single-section flexible floating bodies are sequentially connected to form a flexible floating body which is arc-shaped as a whole; every two adjacent single-section flexible floating bodies are connected through a butt joint device; each single-section flexible floating body comprises a plurality of longitudinal flexible rods; flexible transverse nets and flexible longitudinal nets; two ends of the longitudinal flexible rods are connected with transverse fixing structures at two ends of the corresponding single-section flexible floating bodies, respectively; the flexible transverse nets and the flexible longitudinal nets are arranged between the longitudinal flexible rods in a spaced and covering manner; a plurality of buoyancy balls are arranged in each single-section flexible floating body; the stabilizing buoys are fixed with the flexible floating body; the interception net aprons are arranged at the bottom of the flexible floating body; counterweights are arranged at the bottoms of the interception net aprons; the garbage collection nets are arranged between two adjacent single-section flexible floating bodies; and the flexible floating body is provided with a mooring system;

wherein the transverse nets are arranged among the single-section flexible floating bodies for preventing movement of the buoyancy balls between the single-section flexible floating bodies that resulting in uneven force on the single-section flexible floating bodies; the longitudinal nets are for preventing the buoyancy balls 10 from being squeezed out from between the single-section flexible floating bodies and overflowing into the sea; and the collection nets are for collecting the floating garbage.

2. The floating garbage cleaning device for the floating garbage on the water of claim 1, characterized in that the single-section flexible floating body is in the shape of a cylinder, the barrier net is installed on the transverse fixing structure between every two adjacent single-section flexible floating bodies, and one garbage collection net is hung between two adjacent barrier nets.

3. The floating garbage cleaning device for the floating garbage on the water of claim 1, characterized in that a plurality of stabilizing buoys are arranged, and a plurality of solar power generation panels for providing energy are arranged between the stabilizing buoys and the single-section flexible floating bodies; wherein the stabilizing buoys are connected by the butt joint device.

4. The floating garbage cleaning device for the floating garbage on the water of claim 1, characterized in that the mooring system comprises mooring cables and an anchor; the number of the mooring cables is three in total; two ends of two of the three mooring cables are respectively connected with the single-section flexible floating bodies and a transition buoy; one end of the other one of the three mooring cables is connected with the transition buoy and the other end thereof is fixed to a water bottom through the anchor; and the transition buoy is arranged near the middle of an arc-shaped opening of the flexible floating body.

5. The floating garbage cleaning device for the floating garbage on the water of claim 1, characterized by further being provided with a positioning cable which is respectively connected to two ends of the flexible floating body to keep a certain arc shape of the flexible floating body, the shape and radian of the flexible floating body being adjusted by changing a length of the positioning cable.

* * * * *